United States Patent [19]

Bruning

[11] Patent Number: 4,648,142

[45] Date of Patent: Mar. 10, 1987

[54] APPARATUS AND METHOD FOR SUPPORTING AN INFANT IN A GENERALLY SEMI-FOWLER POSITION

[76] Inventor: Rose M. Bruning, 405 S. 127th St., Omaha, Nebr. 68154

[21] Appl. No.: 660,716

[22] Filed: Oct. 15, 1984

[51] Int. Cl.[4] ..... A47D 9/00

[52] U.S. Cl. ..... 5/93 R; 5/62; 5/424; 5/431

[58] Field of Search ..... 5/62, 93 R, 424, 431–433, 5/436, 446, 462, 465, 494, 411, 460, 470, 435, 437, 490, 497, 499; 128/134, 135

[56] References Cited

U.S. PATENT DOCUMENTS

| | | | |
|---|---|---|---|
| D. 256,870 | 9/1980 | Britzman | 5/490 |
| D. 259,458 | 6/1981 | Fuller et al. | 5/431 |
| 909,453 | 1/1909 | Pullman | 5/432 |
| 1,295,770 | 2/1919 | Lamont | 5/465 |
| 2,094,553 | 9/1937 | Shaw | 5/93 |
| 2,562,725 | 7/1951 | Leto et al. | 5/431 |
| 2,607,929 | 8/1952 | Balluff | 5/2 R |
| 2,644,173 | 7/1953 | James | 5/93 |
| 2,682,673 | 7/1954 | Myers | 5/490 |
| 2,724,133 | 11/1955 | Sorrell | 5/446 |
| 2,751,268 | 6/1956 | Creelman | 5/494 |
| 3,121,885 | 2/1964 | Cherry | 5/494 |
| 3,305,878 | 2/1967 | Hellbaum | 5/465 |
| 3,363,272 | 1/1968 | Channon | 5/431 |
| 3,382,510 | 5/1968 | Robinson | 5/435 |
| 3,537,115 | 11/1970 | Gordin | 5/93 R |
| 3,811,140 | 5/1974 | Burpo | 5/431 |
| 4,092,752 | 6/1978 | Dougan | 5/459 |
| 4,173,048 | 11/1979 | Varaney | 5/494 |
| 4,254,518 | 3/1981 | Buhren et al. | 5/424 |
| 4,256,096 | 3/1981 | Budde | 5/433 |
| 4,383,713 | 5/1983 | Roston . | |
| 4,441,221 | 4/1984 | Enste et al. | 5/465 |
| 4,471,767 | 9/1984 | Guimond | 5/431 |
| 4,574,412 | 3/1986 | Smith | 5/436 |

FOREIGN PATENT DOCUMENTS

| | | | |
|---|---|---|---|
| 1031814 | 6/1966 | United Kingdom | 5/436 |

*Primary Examiner*—Gary L. Smith
*Assistant Examiner*—Michael F. Trettel
*Attorney, Agent, or Firm*—Zarley, McKee, Thomte, Voorhees & Sease

[57] ABSTRACT

A pad of a size to fit onto the mattress of a baby crib has an elongated cut-out central recess of a length longer than an infant and of a width sufficient for an infant to be placed therein without contacting the sides but narrow enough to prevent the infant from turning around so that the infant is maintained in a semi-fowler position. Bed coverings for at least the sides of the opening are provided as well as a system for securing the pad in position on an inclined surface.

11 Claims, 5 Drawing Figures

APPARATUS AND METHOD FOR SUPPORTING AN INFANT IN A GENERALLY SEMI-FOWLER POSITION

BACKGROUND OF THE INVENTION

This invention is directed generally to an apparatus and method for supporting an infant in a semi-fowler position and more particularly to the construction and use of an infant positioning device having an opening therein for restraining an infant positioned within the opening from altering its position by any substantial change of direction.

In the treatment of infant and pediatric patients afflicted with gastroesophageal reflux and related conditions, it is necessary to elevate the patient to a semi-fowler position to alleviate the complications of these conditions. Such elevation of the patient prevents the acid contents of the stomach from regurgitating upward to irrigate and inflame the esophageal lining and related organs in gastroesophageal reflux.

Devices are available in the prior art for restraining an infant in a semi-fowler position, such devices including certain strollers, infant car seats and the like. Such devices are too restrictive for comfortable sleeping on a regular basis, however. Infants can be placed on an inclined mattress with several pillows used to confine the infant to the desired position but such pillows can be moved by an infant. Furthermore, pillows used on a regular basis will eventually present an unsanitary confinement unless all of the pillow covers are removed and laundered.

Accordingly, a primary object of the invention is to provide an improved apparatus and method for maintaining an infant in a semi-fowler position.

Another object is to provide such an apparatus and method which are safe, convenient and effective.

Another object is to provide such an apparatus which allows the infant or pediatric patient to rest on the conventional mattress surface.

Another object is to provide such an apparatus having an opening of adjustable size to accommodate pediatric patients of different sizes.

Another object is to provide such an apparatus which is simple in construction, inexpensive to manufacture, easy to use and efficient in operation.

SUMMARY OF THE INVENTION

The apparatus for maintaining an infant or pediatric patient in a generally semi-fowler position includes a pad adapted for support on a conventional mattress surface. The pad has an elongated opening therein of a size and shape for receiving a pediatric patient positioned on the mattress. The opening has a width which is sufficiently limited to restrain the patient from altering its position by any substantial change of direction. When the centerline of the opening is aligned with the direction of slope of the supporting surface such as a mattress, an infant placed in the opening with its head at the raised end of the underlying surface will be comfortably maintained in a semi-fowler position.

A bed covering is fitted onto the pad so as to cover at least the top surface thereof and the sides of the opening to present a clean sanitary environment for the pediatric patient. In a preferred embodiment, the pad is of a size and shape adapted for placement onto the mattress of a child's crib and fastening means are provided for securing the pad in position on the crib mattress.

DESCRIPTION OF A PREFERRED EMBODIMENT

Figure 1:
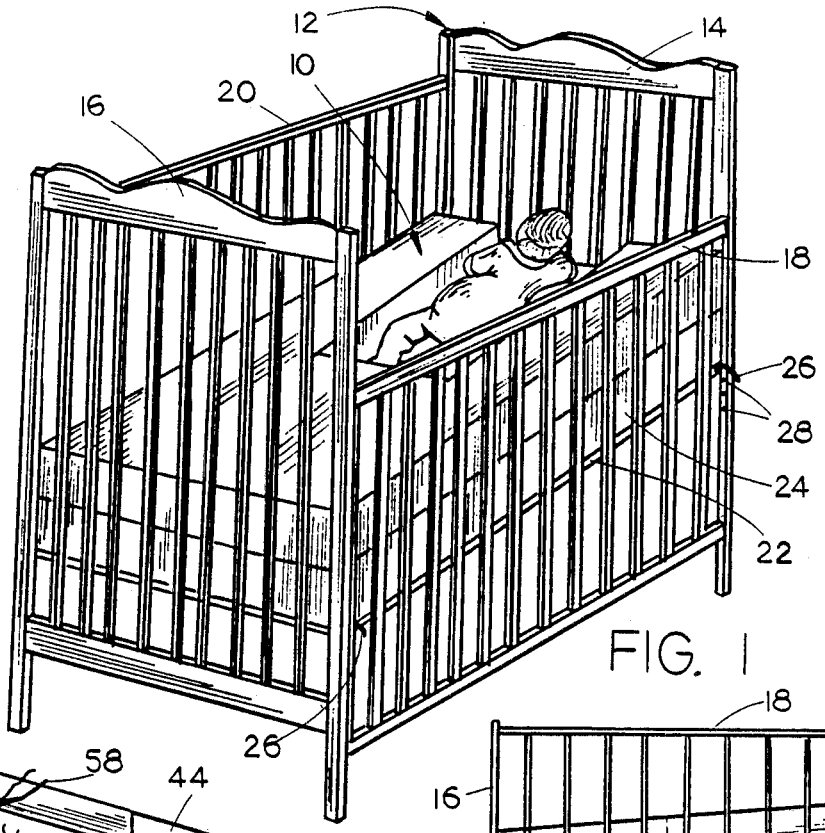
FIG. 1 is a perspective view showing an infant maintained in a semi-fowler position on a crib mattress by the apparatus of the invention.

The apparatus 10 of the present invention for maintaining an infant in a generally semi-fowler position is shown in FIG. 1 in association with a conventional crib 12. The crib has a headboard 14, foot board 16 and opposite side boards 18 and 20, a mattress support frame 22 and a mattress 24 resting on frame 22. A height-adjustable support system is provided for supporting the frame 22 on the crib. A popular conventional system includes pivotal corner hangers 26 on the four corners of the frame, which hangers can be selectively placed onto a plurality of vertically spaced support hooks 28 on the adjacent headboard or foot board. Thus it is an easy matter to simply raise the hangers at the head end of the bed onto higher hooks for elevating the head end of the mattress above the foot end.

The infant positioning device 10 is a self-contained one-piece, U-shaped foam device adapted for placement onto a crib mattress 24 as shown. The foam pad 30 is preferably of a size to substantially conform to and cover the mattress 24 of a baby crib but for an elongated cut-out opening 34 of a length longer than an infant and of a width sufficient for an infant to be placed therein without contacting the sides 36 and 38 but narrow enough to prevent the infant from turning around, end-to-end. Thus the pad 30 may be considered as including a generally square main body portion 40 and a pair of arms 42 and 44 extended outwardly therefrom in spaced-apart relation.

A removable U-shaped insert 46 may be provided, which precisely fits into opening 34 for reducing the length and width thereof to accommodate pediatric patients of smaller size. The insert has the same thickness of pad 30.

Whereas the precise dimensions of the pad 30 and opening 34 are not critical to the present invention, a preferred embodiment has been constructed with the following dimensions: 50 inches by 26 inches by 6 inches with opening 34 having dimensions of 12 inches by 29½ inches and the opening defined by insert 46 measuring 10 inches by 27 inches. The preferred range of dimensions for opening 34 includes a width of between 7 and 15 inches and a length of at least 20 inches.

Figure 5:
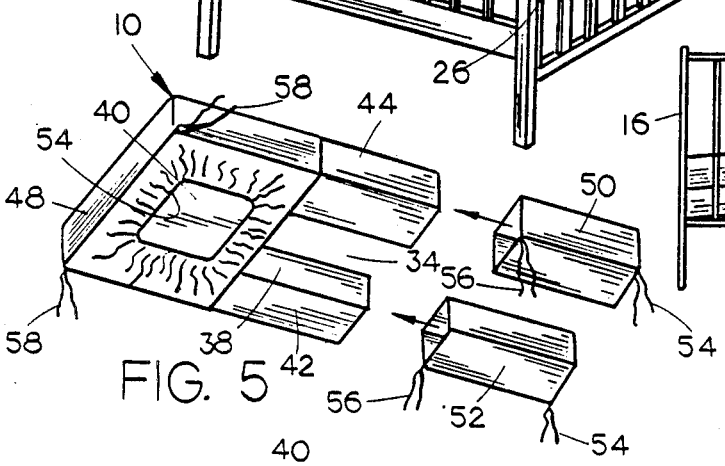
FIG. 5 is a partly exploded perspective view showing the device of the invention with the bed coverings thereof.
Figure 2:
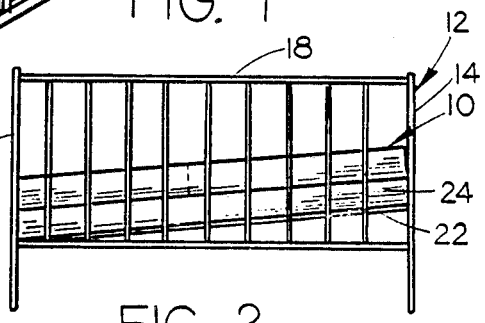
FIG. 2 is a side elevational view of the invention as placed on a mattress of a crib.
Figure 3:
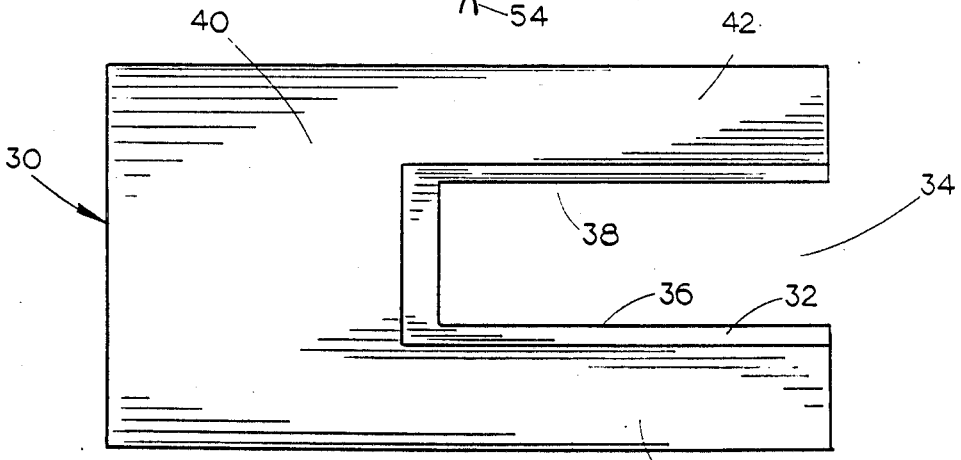
FIG. 3 is a top plan view of the invention.
Figure 4:
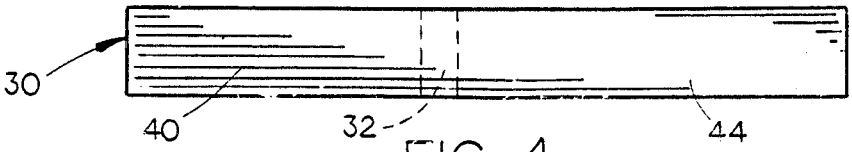
FIG. 4 is a side elevational view of the invention.

For purposes of sanitation and safety, the foam pad 30 is covered by a removable fire resistant fitted sheet 48 and a pair of slip covers 50 and 52, as shown in FIG. 5. Sheet 48 may be constructed as a conventional fitted sheet with elastic 54 but with openings through one side to accommodate arms 42 and 44. The slip covers 50 and 52 may be sewn tubular members with the forward end closed for covering all of the exposed surfaces of the arms 42 and 44. It is apparent that the sheet and slip covers may take various forms. The important aspect is that the surfaces contacting the patient be covered. Furthermore, it is preferred that the slip covers are not easily removed by an infant thereby eliminating the possibility of injury to the infant.

Finally, the pad is secured in position on the mattress by means such as the tie strings 54, 56 and 58 shown in FIG. 5 secured to the slip covers and sheet respectively. In the embodiment shown, the very size of the pad tends to secure its position within the crib as does the frictional engagement between the pad and mattress. On inclined surfaces wherein confining side walls are not present, the frictional engagement between the pad and inclined surface may be sufficient to secure the pad in a stationary position. Other fasteners may be provided for additional security.

In operation, an infant or pediatric patient is placed onto the mattress 24 with its head toward the raised end of the mattress in the opening 34 so that its head is positioned at a raised elevation relative to its feet. The infant can comfortably rest, move its arms and legs and raise its head for ready visibility of its surroundings. The position of the opening at one end of the pad also improves the infant's view and minimizes any feeling of confinement by the pad. Whereas an infant may be able to roll over from its stomach to its back and vice versa, the width of the opening 34 is sufficiently limited to restrain the infant from altering its position by any substantial change of direction. Accordingly, it cannot turn around end-to-end with the result that its head is maintained at the elevated end of the opening. An approximate 30° incline of the mattress is generally appropriate for the semi-fowler position.

The device of the invention is useful for the treatment of all conditions requiring elevation of the patient to the semi-fowler position, while sleeping or resting. Specifically, these conditions include the following:

1. Gastroesophageal reflux. A condition caused by the abnormal displacement and relaxation of the normally closed muscular ring at the base of the esophagus, known as the cardiac sphincter. The manifestation of this condition causes some of the acid contents of the stomach to flow upward to irrigate and inflame the esophageal lining and related organs.

2. Infantile colic. Defined as any severe abdominal pain of a spasmodic nature, caused by contractions of the smooth muscle in the walls of a hollow organ under tension. Though unspecific in origin, it is generally felt that elevation of the upper torso relaxes and is effective in the treatment of infantile colic symptoms.

3. Tormina. Defined as intestinal infantile colic with griping pains.

4. Dyspepsia. Not a disease in itself but symptomatic of other disease or disorders. It is characterized by vague abdominal discomfort, a sense of fullness after eating, eructation, heartburn, nausea and vomiting, and loss of appetite. These symptoms may occur irregularly and in different patterns from time-to-time. Dyspepsia can be simplified to mean imperfect digestion.

5. Dyspnea. Defined as air hunger resulting in labored or difficult breathing, sometimes accompanied by pain. It is caused by insufficient oxygenation of the blood resulting from disturbances in the lungs, low oxygen pressure of air, circulatory disturbances and hemoglobin deficiency. Other causes may be acidosis, excessive carbon dioxide content of blood, lesions of the respiratory center, emotional excitation, hyper excitability of Hering-Breur reflex, cardiac asthma, and orthopnea.

6. Diaphragmatic or hiatus hernise. The protrusion of part of the abdominal content, through a defect in the wall of the abdominal cavity, into the thorax. Occasionally, this forms in the newborn as a result of a developmental defect in the diaphragm.

7. Umbilical hernia. A condition which may be found at birth, caused by failure of part of the bowel to return with the abdominal cavity from its developmental position within the umbilical cord; or, more rarely, it may be the result of infection of the umbilicus soon after birth.

8. Any and all conditions that require elevation to a semi-fowler position during resting or sleeping, so as to properly aid in the treatment of the conditions. Fowler's position is defined as simply a semi-sitting position.

Thus there has been shown and described an apparatus and method for supporting a pediatric patient in a generally semi-fowler position, which apparatus and method accomplish at least all of the stated objects.

I claim:

1. An apparatus for supporting an infant in a generally semi-fowler position, comprising in combination, a crib including head, foot and opposite side boards, a generally planar mattress support frame, height adjustable support means for supporting the opposite ends of said mattress support frame on said crib, and a generally flat mattress resting on said mattress support surface, an infant positioning device supported on said mattress, said infant positioning device comprising a generally U-shaped pad having opposite closed and open ends and an elongated opening therethrough of a size and shape for receiving an infant on said mattress, a bed covering fitted onto said pad so as to cover at least the top sides of said opening, and means for securing said pad in a position on said mattress, said opening having a width and length which is sufficiently limited to restrain an infant from altering its position by any substantial change of direction, and the open end of said pad facing the headboard and the longitudinal centerline of said opening being generally parallel to said side boards whereby, upon elevation of the head end of the mattress above the foot end thereof, an infant placed in said opening with its head facing the head board will be maintained in a semi-fowler position.

2. The apparatus of claim 1 wherein said opening is generally rectangular in shape.

3. The apparatus of claim 1 wherein the width of said opening is between 7 and 15 inches.

4. The apparatus of claim 3 wherein said pad has a thickness of between 3 and 9 inches.

5. The apparatus of claim 1 wherein said pad substantially covers said mattress but for said opening.

6. The apparatus of claim 1 wherein said means for securing said pad in position on said mattress comprises fasteners secured to said bed covering and adapted for engagement with said crib boards.

7. The apparatus of claim 1 wherein said bed covering includes a fitted sheet portion and a pair of slip covers adapted to cover respective sides of said opening.

8. A method for supporting an infant in a generally semi-fowler position, comprising providing a substantially planar inclined surface adapted for supporting an infant at rest, said surface having upper and lower ends, placing on said surface an infant positioning device including a generally U-shaped pad having opposite closed and open ends and an elongated opening of a size and shape for receiving an infant on said surface, which opening has a width and length which is sufficiently limited to restrain an infant from altering its position by any substantial change in direction, arranging said pad with the open end of said pad facing said upper end and the longitudinal centerline of said opening generally parallel to the direction of incline of said surface, and placing an infant onto said surface in said opening with the infant's head at the raised end of the surface in said opening whereby the infant is maintained in the semi-fowler position.

9. The method of claim 8 further comprising securing said pad in position on said surface.

10. The method of claim 8 further comprising covering at least the top surface of said pad and sides of said opening with a bed covering.

11. An apparatus for supporting an infant in a generally semi-fowler position, comprising in combination, a crib including head, foot and opposite side boards, a generally planar mattress support frame, height adjustable support means for supporting the opposite ends of said mattress support frame on said crib, and a generally flat mattress resting on said mattress support surface, an infant positioning device supported on said mattress, said infant positioning device comprising a pad having an elongated opening therethrough of a size and shape for receiving an infant on said mattress, said opening having at least one closed end, a bed covering fitted onto said pad so as to cover at least the top sides of said opening, and means for securing said pad in position on said mattress, said opening having a width and length which is sufficiently limited to restrain an infant from altering its position by any substantial change of direction, and the one closed end of said pad facing the foot board and the longitudinal centerline of said opening being generally parallel to said side boards whereby, upon elevation of the head end of the mattress above the foot end thereof, an infant placed in said opening with its head facing the head board will be maintained in a semi-fowler position.

* * * * *